United States Patent [19]

Lindsey

[11] Patent Number: 5,016,881

[45] Date of Patent: May 21, 1991

[54] NUMERIC GENERATOR APPARATUS

[76] Inventor: Kyle Lindsey, 852 W. "C" St., Colton, Calif. 92324

[21] Appl. No.: 459,205

[22] Filed: Dec. 29, 1989

[51] Int. Cl.[5] ..... A63B 71/06

[52] U.S. Cl. ..... 273/138 A; 401/195

[58] Field of Search ..... 273/138 R, 138 A, 144 B; 401/195; 411/292, 293

[56] References Cited

U.S. PATENT DOCUMENTS

| | | | |
|---|---|---|---|
| 2,841,156 | 7/1958 | Herald | 401/195 |
| 4,059,891 | 11/1977 | Panagiotoulis | 30/50 |
| 4,530,503 | 7/1985 | Rice | 273/144 B |
| 4,541,630 | 9/1985 | Dirks | 273/144 B |
| 4,801,145 | 1/1989 | Arevalo | 273/143 R |

FOREIGN PATENT DOCUMENTS

| | | | |
|---|---|---|---|
| 3238373 | 4/1984 | Fed. Rep. of Germany | 273/138 A |
| 747799 | 4/1956 | United Kingdom | 273/144 B |

*Primary Examiner*—Edward M. Coven
*Assistant Examiner*—Sebastiano Passaniti
*Attorney, Agent, or Firm*—Leon Gilden

[57] ABSTRACT

An apparatus providing a housing including a sequential numeric generator provided with a stop reset button is mounted to an associated writing instrument. The apparatus includes a cylindrical bore formed with a cylindrical tooth insert mounted within the bore to lock the associated housing to a writing instrument. The housing includes a stop reset button, and further includes a scraper blade member for use in scraping masking coatings of typical lottery type tickets. The generator is utilized to generate sequential numbers to assist individuals in selecting lottery type double digit random numbers in lottery type procedures.

1 Claim, 4 Drawing Sheets

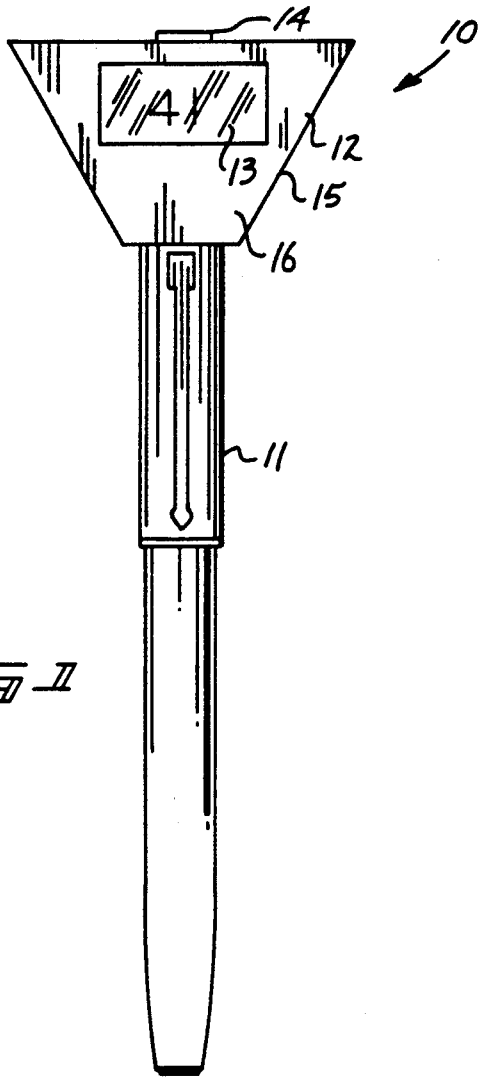
Fig 1
Fig 2
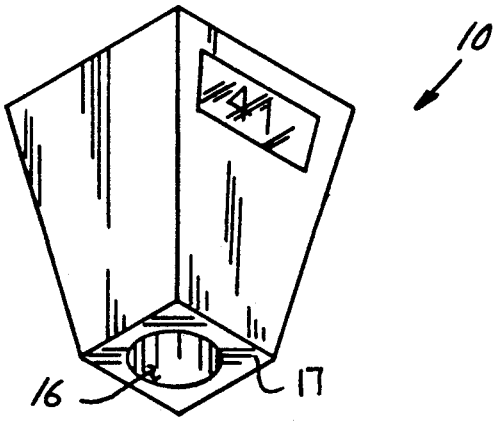

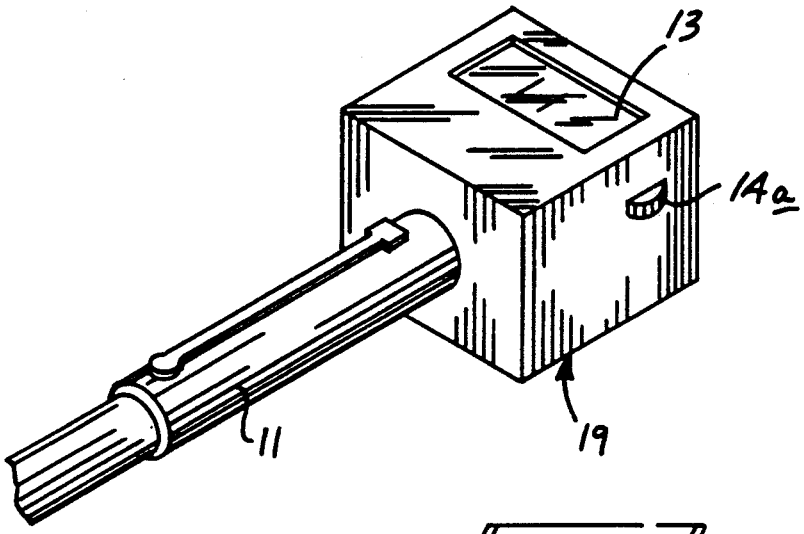
Fig 3
Fig 4
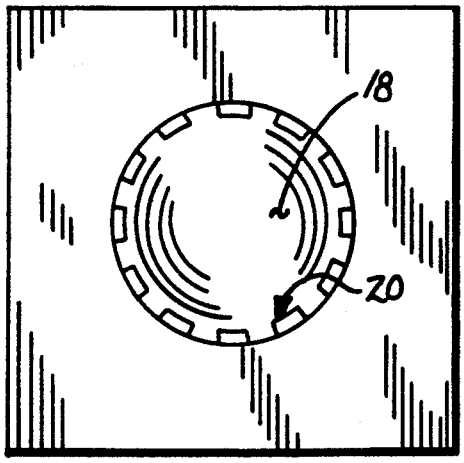

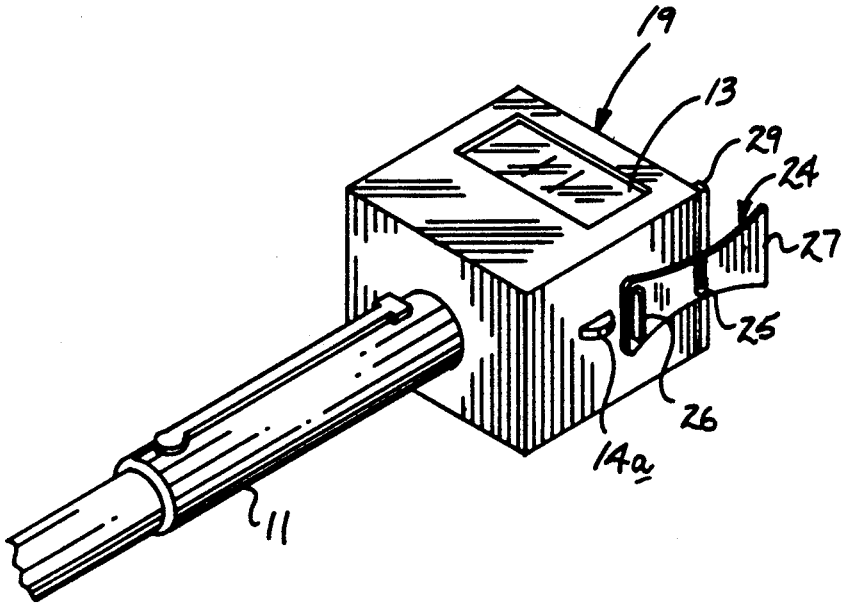
FIG 7
FIG 8
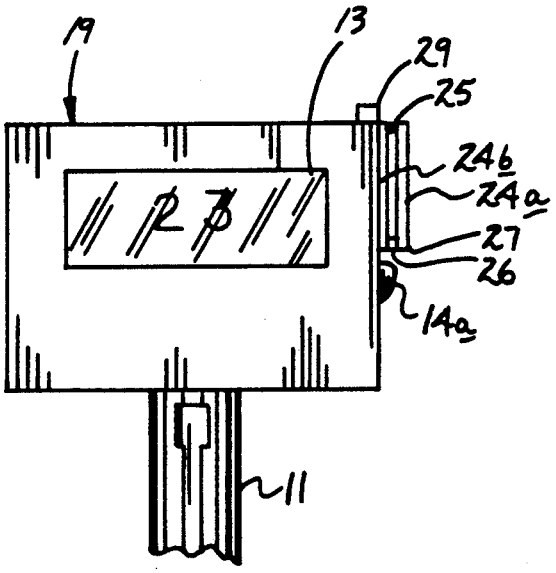

NUMERIC GENERATOR APPARATUS

BACKGROUND OF THE INVENTION

1. Field of the Invention

The field of invention relates to numeric generators, and more particularly pertains to a new and improved numeric generator device for securement to an associated writing instrument to assist individuals in selection of lottery type numbers.

2. Description of the Prior Art

Number generators of the prior art have included structures of complex and expansive organizations to develop numbers for various situations. The instant invention is directed to assisting individuals in developing numbers in a random fashion for selection in a lottery type scenario. Examples of the prior art include U.S. Pat. No. 4,713,787 to Rapp wherein the patent sets forth an addition to a typical four-function calculator to generate random combinations.

U.S. Pat. No. 4,641,840 to Larson wherein a polymeric cube presents a seven segment numeric display on each of its six facets with a circuit setting forth a random number generator and motion sensing switch, wherein cube movement is operative to impress various numbers on each of the sides of the cube.

U.S. Pat. No. 4,216,965 to Morrison, et al., sets forth a sequence association game to enable an individual to play a multiple of games against a device including a single microprocessor.

U.S. Pat. No. 4,618,927 to Hatta sets forth an electronic game apparatus with a calculator including a display to display one or more target symbols as digits in association with the game indicia.

U.S. Pat. No. 4,087,092 to Krause, et al., wherein a lottery number is generated and printed on an associated ticket for use in presenting lottery tickets in association with various machines, such as cash register receipts and the like.

As such, it may be appreciated that there is a continuing need for a new and improved numeric generator apparatus wherein the same generates random numbers for use by an individual in the playing and selection of lottery numbers in a readily securable version in association with a writing instrument to enable an individual to have availably of a writing instrument in the notation and calculating of desired numbers for play in a lottery type game and in this respect, the present invention substantially fulfills this need.

SUMMARY OF THE INVENTION

In view of the foregoing disadvantages inherent in the known types of numeric generators now present in the prior art, the present invention provides a numeric generator apparatus wherein the same is selectively securable to a writing instrument for availability of a writing instrument by individuals in the play and notation of numbers utilized in lottery type games for ease of transport of the apparatus in use. As such, the general purpose of the present invention, which will be described subsequently in greater detail, is to provide a new and improved numeric generator apparatus which has all the advantages of the prior art numeric generators and none of the disadvantages.

To attain this, the present invention provides an apparatus including a housing with a sequential numeric generator provided with a stop reset button mounted to an associated writing instrument. The apparatus includes a cylindrical bore formed with a cylindrical toothed insert mounted within the bore to lock the associated housing to a writing instrument. The housing includes a stop reset button, and further includes a scraper blade member for use in scraping masking coatings of typical lottery type tickets. The generator is utilized to generate sequential numbers to assist individuals in selecting lottery type double digit random numbers in lottery type procedures.

My invention resides not in any one of these features per se, but rather in the particular combination of all them herein disclosed and claimed and it is distinguished from the prior art in this particular combination of all of its structures for the functions specified.

There has thus been utilized, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstact is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved numeric generator apparatus which has all the advantages of the prior art numeric generators and none of the disadvantages.

It is another object of the present invention to provide a new and improved numeric generator apparatus which may be easily and efficiently manufactured and marketed.

It is a further object of the present invention to provide a new and improved numeric generator apparatus which is of a durable and reliable construction.

An even further object of the present invention is to provide a new and improved numeric generator apparatus which is susceptible of a low cost of manufacture with regard to both materials and labor, and which accordingly is then susceptible of low prices of sale to the consuming public, thereby making such numeric generator apparatus economically available to the buying public.

Still yet another object of the present invention is to provide a new and improved numeric generator apparatus which provides in the apparatuses and methods of the prior art some of the advantages thereof, while simultaneously overcoming some of the disadvantages normally associated therewith.

Still another object of the present invention is to provide a new and improved numeric generator apparatus wherein the same sequentially presents double digit lottery number selection upon a display in an organization for securement to a writing instrument.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic view taken in elevation of the instant invention.

FIG. 2 is an isometric illustration of the instant invention removed from a writing instrument.

FIG. 3 is an isometric illustration of the instant invention is a further configuration.

FIG. 4 is a bottom orthographic view of the instant invention.

FIG. 7 is an isometric illustration of the modification of the instant invention is utilization with a further positioning magnet mounted to a top surface of the housing.

FIG. 8 is an orthographic view taken in elevation of the modification of the instant invention of FIG. 7.

DESCRIPTION OF THE PREFERRED EMBODIMENT

Figure 5:
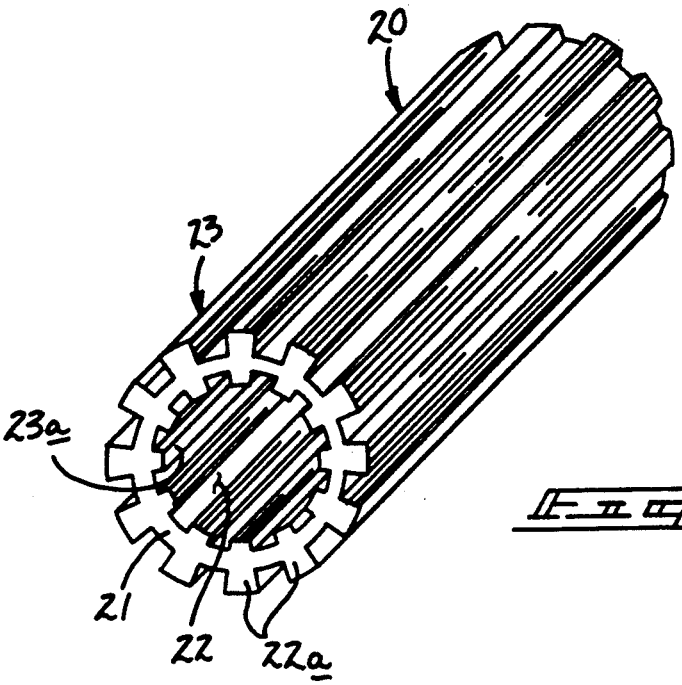
FIG. 5 is an isometric illustration of a tooth securement insert received within the mounting bore of the instant invention.

With reference now to the drawings, and in particular to FIGS. 1 to 8 thereof, a new and improved numeric generator apparatus embodying the principles and concepts of the present invention and generally designated by the reference numeral 10 will be described.

More specifically, the numeric generator apparatus 10 essentially comprises a housing 12 mounted to an associated writing instrument 11 of a generally cylindrical configuration. The housing 12 includes sloping side walls 15 with associated sloping forward and rear walls 16. A formed wall of the housing 12 includes a numeric display 13 presenting a double digit LED (light emitting diode) display 13 directed by circuitry to sequentially generate a double digit sequential series of numbers from 0 through 49 or 0 through 99, dependent upon the lottery number sequencing required by lottery games. U.S. Pat. No. 4,713,787 (incorporated herein by reference) sets forth a typical number generating circuitry available in the prior art.

The organization includes a reset button 14 mounted to a top surface of the housing 12 to manually stop the random number sequencing and restart the sequencing as desired by an individual. The sloping side walls 15 of the housing provide an advantageous clearance for enhancing manual grasping of the associated writing instrument 11 mounted orthogonally and downwardly from a bottom wall 17 of the housing. FIG. 2 illustrates the bottom wall 17 with an associated writing instrument mounting board 18 mounted and formed coaxially to the bottom wall 17 to receive an upper end of the writing instrument 11 therewithin.

FIG. 3 is illustrative of a modified cubic housing 19 that is alternatively utilized by the instant invention. The housing includes planar side walls, as well as a planar bottom wall, formed with the writing instrument bore 18 therewithin. A repositioned reset button **14*a* is mounted upon a side wall of the housing 19 to enable a thumb access to the reset button 14*a*** in use of the organization.

The bore 18 is provided with a resilient cylindrical toothed insert 20, as illustrated in FIGS. 4 and 5 for example. The insert 20 is formed with a main cylindrical support 21 formed with a fluted exterior surface 22 and a fluted interior surface 23. The fluted exterior surface 22 includes radially aligned external radial ribs **22*a* mounted at equally spaced intervals about the exterior surface of the cylindrical support 21, with internal radial ribs 23*a* mounted interiorly of the cylindrical support 21, wherein the ribs 22*a* and 23 *a* are aligned to provide enhanced rigidity in their securement of an internal wall of the bore 18 and an external wall of the writing instrument 11. It is understood that the tooth insert 20 is formed of a relatively resilient polymeric compound to enhance its frictional engagement of the bore 18 and the writing instrument 11** simultaneously.

Figure 6:
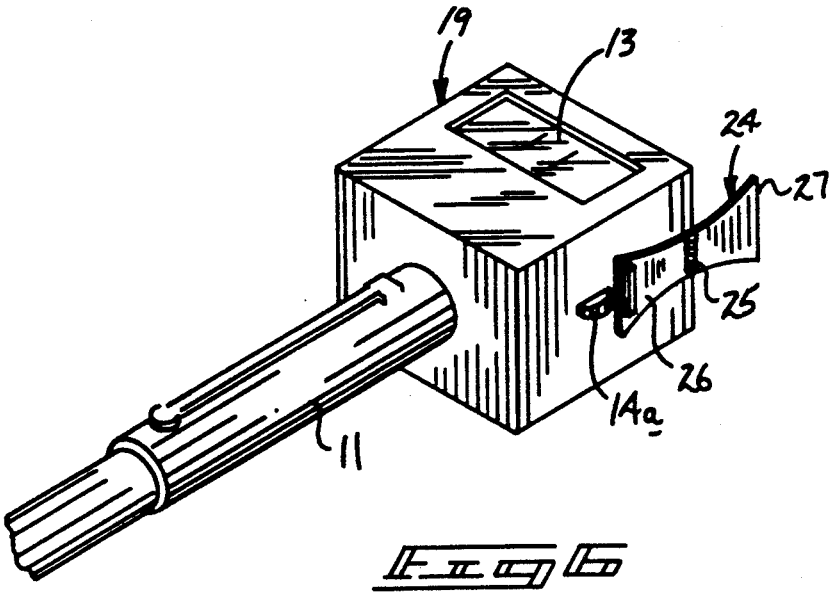
FIG. 6 is an isometric illustration of a modification utilized by the instant invention.

FIGS. 6 through 8 illustrate the use of an additional lottery ticket scraper blade 24 mounted to a side surface of the housing 19 overlying the reset button **14*a*. The scraper blade is utilized by individuals in playing of a lottery type game in the scraping of a masking coating over numbers presented by lottery ticket generating machines. The blade 24 comprises an upper blade 24*a* mounted to a lower blade support plate 24*b* by a hinge 25 aligned with a top edge surface of that housing 19. The upper blade plate 24*a* and associated blade edge 24 are maintained in an upper position, as illustrated in FIGS. 6 and 7, by a second magnet 29 aligned with a side wall securing the blade 24 thereto, with a first magnet 26 projecting orthogonally above the top surface of the lower blade support plate 24*b* to maintain the upper blade plate 24*a*** in the lowered orientation.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassedy by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the U.S. is as follows:

1. A numeric generator apparatus in combination with and secured selectively to an upper terminal end of an elongate writing instrument, the apparatus comprising, a housing including a plurality of spaced side walls, a forward wall, a rear wall, a top wall, and a bottom wall, and a numeric LED display for displaying a sequential series of digit integers, wherein the display is mounted on the forward wall, and a button means mounted on a wall of a housing for manually controlling the initiation and cessation of the sequential display of integers, and a mounting means for mounting the housing onto an upper terminal end of the writing instrument, and wherein the bottom wall includes a coaxially aligned mounting bore, and further including a resilient cylindrical toothed insert positioned within the mounting bore to secure the upper terminal end of the writing instrument therewithin;

and wherein the toothed insert is defined by a main cylindrical support including a series of external ribs extending radially exteriorly of the cylindrical toothed insert, and a series of internal radial ribs directed interiorly of the cylindrical toothed insert, wherein the external and internal ribs are aligned relative to one another to enhance frictional engagement of an interior surface of the bore and an exterior surface of the writing instrument, and further including a pivotally mounted scraper blade secured to one of said side walls, wherein the scraper blade includes a medially aligned hinge, the hinge in alignment with an upper terminal edge of the one of said side walls, and the scraper blade including a lower support plate fixedly mounted to the one of said side walls and an upper plate pivotally mounted to the lower support plate by the hinge, and wherein the lower support plate includes a first magnet to secure the upper blade at a lower position, and a second magnet positioned in alignment with the top wall adjacent the one of said side walls to secure the upper blade in a raised position.

* * * * *